US005081895A

United States Patent [19]

Katsuta

[11] Patent Number: 5,081,895

[45] Date of Patent: Jan. 21, 1992

[54] KEYBOARD

[75] Inventor: Masanori Katsuta, Iwata, Japan

[73] Assignee: Kabushiki Kaisha Kawai Gakki Seisakusho, Shizuoka, Japan

[21] Appl. No.: 550,626

[22] Filed: Jul. 10, 1990

[30] Foreign Application Priority Data

Aug. 11, 1989 [JP] Japan ..... 93874

[51] Int. Cl.[5] ..... G10C 3/12

[52] U.S. Cl. ..... 84/433

[58] Field of Search ..... 84/433, 434, 435, 436, 84/437

[56] References Cited

U.S. PATENT DOCUMENTS 3,306,152 2/1967 Klann ..... 84/433
3,561,315 2/1971 Ohno ..... 84/433
3,979,990 9/1976 Hinago ..... 84/719
4,351,222 9/1982 Kumano ..... 84/423 R

FOREIGN PATENT DOCUMENTS 51-74427 6/1976 Japan .
61-16592 1/1986 Japan .
61-198996 12/1986 Japan .

*Primary Examiner*—L. T. Hix
*Assistant Examiner*—Howard B. Blankenship
*Attorney, Agent, or Firm*—Irving M. Weiner; Joseph P. Carrier; Robert M. Petrik

[57] ABSTRACT

A keyboard in which a stopper portion of an upper limit stopper of a black key detours an upper limit stopper of an adjoining white key so as to lie away from the black key side by side with a stopper portion of the upper limit stopper of the white key.

7 Claims, 2 Drawing Sheets

KEYBOARD

BACKGROUND OF THE INVENTION

1. Field of the Invention

This invention relates to a keyboard of an electronic organ and the like.

2. Description of Relevant Art

In a conventional keyboard of an electronic organ, as shown in FIG. 6, a white key "a" has an upper limit stopper b which is downwardly elongated from a side surface thereof, and a black key c has an upper limit stopper d which is provided slantingly in a forward direction from a bottom surface thereof. The upper limit stopper b of the white key "a" is, as shown in FIG. 7, inserted into an opening f formed in a frame e on which the white key "a" and the black key c are mounted, and contacts a stopper cushion $g_1$ which is provided in a rear portion of the back surface of the frame e. The upper limit stopper d of the black key c is inserted into the opening f so as to contact another stopper cushion $g_2$ which is provided in a front portion of the back surface of the frame e.

According to the above-mentioned conventional keyboard, because the upper limit stopper b of the white key "a" and the upper limit stopper d of the black key c are respectively directed in different directions it is difficult to mount the white key "a" and the black key c on the frame e. Further, separate stopper cushions $g_1$, $g_2$ are required respectively for the white key "a" and the black key c.

SUMMARY OF THE INVENTION

This invention has an object of providing a solution to the above-discussed problems associated with the conventional keyboard.

In order to attain the above object, this invention is characterized in that, in a keyboard, a stopper portion of an upper limit stopper of a black key detours an upper limit stopper of an adjoining white key so as to lie away from the black key side by side with a stopper portion of the upper limit stopper of the white key.

Since the stopper portion of the upper limit stopper of the black key is arranged to detour the upper limit stopper of the white key so as to lie away from the black key side by side with the stopper portion of the upper limit stopper of the white key, a common stopper cushion can be used for the white key and the black key. Also, the assembling of the keys to the frame becomes easier.

DETAILED DESCRIPTION OF PREFERRED EMBODIMENTS

A first embodiment of this invention is described with reference to FIGS. 1 through 3.

Figure 1:
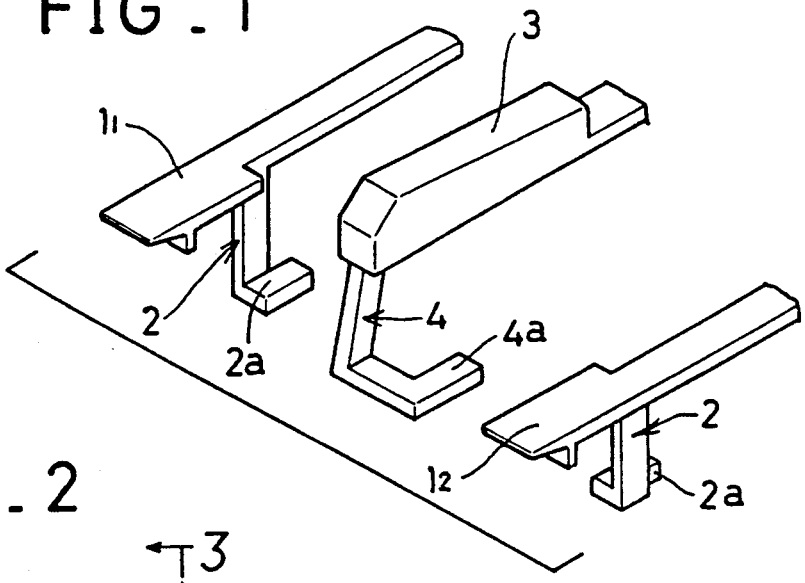
FIG. 1 is an exploded perspective view of several keys of a keyboard according to an embodiment of this invention.
Figure 2:
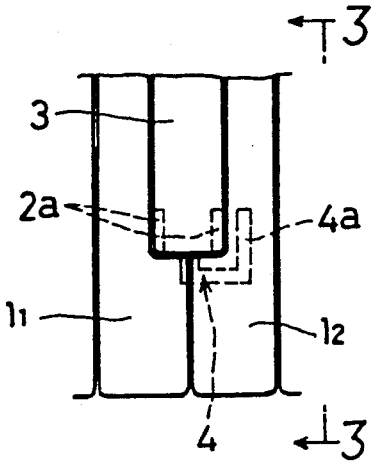
FIG. 2 is a plan view of an important portion thereof.
Figure 3:
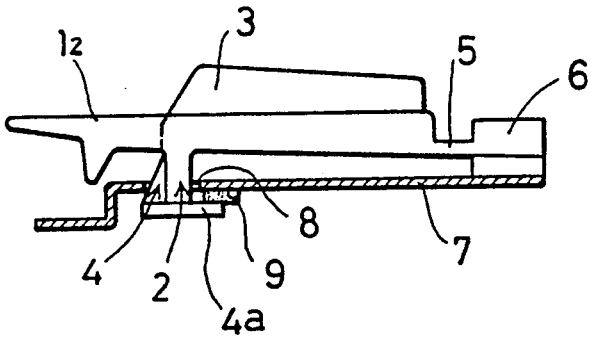
FIG. 3 is a side view thereof seen from the line 3–3 of FIG. 2.

In FIGS. 1 through 3, numerals $1_1$ and $1_2$ denote white keys which are adjacent to each other in a keyboard. Upper limit stoppers 2 having stopper portions 2*a* formed at their bottom ends are downwardly provided respectively on sides of the white keys. Numeral 3 denotes a black key which is interposed between the white keys $1_1$ and $1_2$. On the black key 3 there is provided an upper limit stopper 4 having a stopper portion 4*a* which detours the upper limit stopper 2 of the white key $1_2$ from the front side thereof so that the stopper portion 4*a* lies away from the black key 3 side by side with the stopper portion 2*a* of the white key $1_2$. Consequently, the free ends of both the stopper portions 2*a*, 4*a* extend in the same direction, i.e., rearwardly relative to the keys. As shown in FIGS. 1, 2 the upper limit stopper of the black key is substantially hook- or L-shaped when viewed in plan so as to achieve the discussed detouring function. Relatedly, the resulting disposition of the black key stopper portion is such that it lies further away from the black key than does the stopper portion of the white key, and the stopper of the black key may be disposed entirely beneath the white key as depicted.

The white keys $1_1$, $1_2$ and the black key 3 are respecitvely formed integrally with the upper limit stoppers 2, 4, hinge portions 5 and mounting portions 6, all being made of resin. The white keys $1_1$, $1_2$ and the black key 3 are mounted on a frame 7 in a swingable manner via the hinge portions 5 and the mounting portions 6. The stopper portions 2*a* of the upper limit stoppers 2 of the white keys $1_1$ and $1_2$ as well as the stopper portion 4*a* of the upper limit stopper 4 of the black key 3 are brought into contact, through an opening 8 in the frame 7, with a common stopper cushion 9 which is provided on the back surface of the frame 7.

Figure 4:
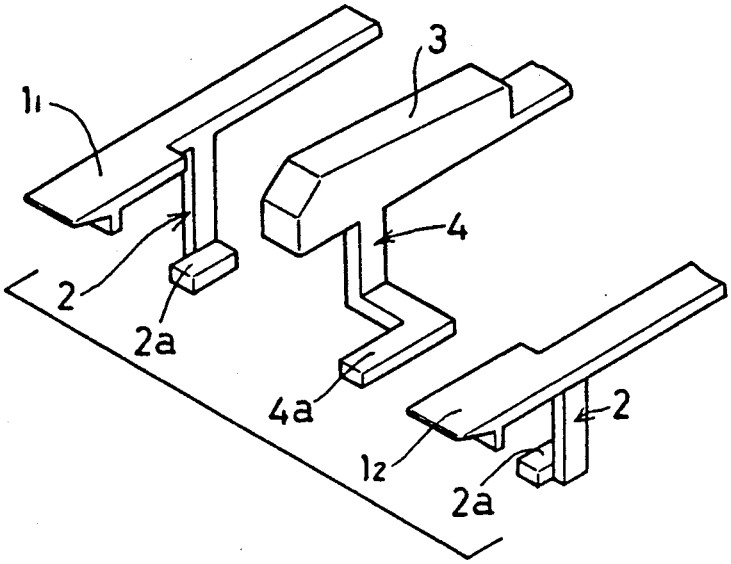
FIG. 4 is an exploded perspective view of several keys of a keyboard according to another embodiment of this invention.
Figure 5:
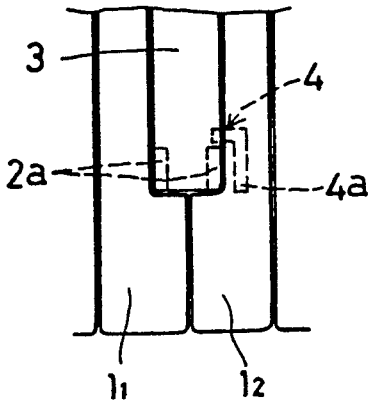
FIG. 5 is a plan view of an important portion thereof.
Figure 6:
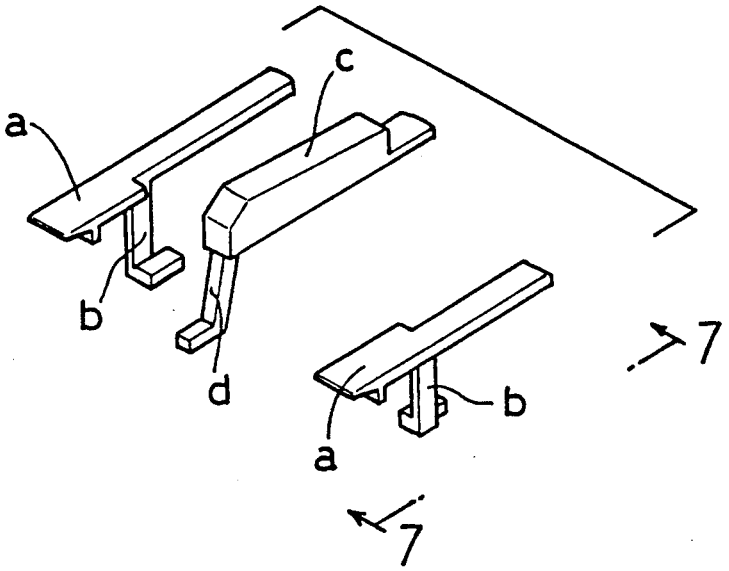
FIG. 6 PRIOR ART
FIG. 6 is an exploded perspective view of several keys of a conventional keyboard.
Figure 7:
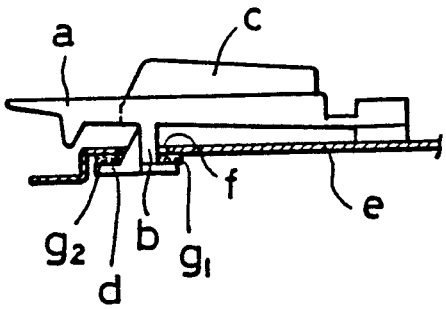
FIG. 7 PRIOR ART
FIG. 7 is a side view thereof seen from the line 7–7 in FIG. 6.

FIGS. 4 and 5 show another embodiment of this invention.

In this embodiment, the black key 3 is provided, contrary to the abovementioned embodiment, with an upper limit stopper 4 having a stopper portion 4*a* which detours the upper limit stopper 2 of the white key $1_2$ from the rear side thereof so that the stopper portion 4*a* lies away from the black key 3 side by side with the stopper portion 2*a* of the white key $1_2$. Just as in the first embodiment the free ends of both the stopper portions 2*a*, 4*a* extend in the same direction, although here the free ends extend forwardly relative to the keys. The other features are the same as in the above-mentioned first embodiment.

Since this invention has the above-mentioned construction, the stopper cushion with which the stopper portions of the white key and the black key come into contact can be made common to both keys, thus reducing the number of components of the keyboard and correspondingly reducing construction costs. In addition, the mounting of the black key and the white key on the frame becomes easier because the stopper portions of the upper limit stoppers of these keys are directed in the same direction.

Although there has been described what are at present considered to be the preferred embodiments of the invention, it will be understood that the invention can be embodied in other specific forms without departing from the spirit or essential characteristics thereof. The present embodiments are, therefore, considered in all aspects as illustrative, and not restrictive. The scope of the invention is indicated by the appended claims rather than by the foregoing description.

I claim:

1. A keyboard in which a stopper portion of an upper limit stopper of a black key detours a stopper portion of an upper limit stopper of an adjoining white key such that said stopper portion of said black key is disposed so as to lie further away from said black key than does said stopper portion of said white key and side by side with said stopper portion of said white key.

2. A keyboard according to claim 1, wherein said stopper portion of the upper limit stopper of the black key detours the upper limit stopper of the white key from a front side thereof.

3. A keyboard according to claim 1, wherein said stopper portion of the upper limit stopper of the black key detours the upper limit stopper of the white key from a rear side thereof.

4. A keyboard according to claim 1, wherein said stopper portions of said upper limit stoppers of said white and black keys extend in the same direction relative to said white and black keys.

5. A keyboard according to claim 1, wherein said upper limit stopper of said black key is substantially L-shaped when viewed in plan.

6. A keyboard according to claim 1, wherein said upper limit stopper of said black key is substantially hook-shaped when viewed in plan.

7. A keyboard apparatus according to claim 1, wherein said stopper portion of said black key is disposed entirely beneath said white key.

* * * * *